US011065618B2

(12) United States Patent
Douglas et al.

(10) Patent No.: US 11,065,618 B2
(45) Date of Patent: Jul. 20, 2021

(54) FLOW BALANCING

(71) Applicant: Fluidic Analytics Limited, Cambridge (GB)

(72) Inventors: Anthony Douglas, Cambridge (GB); Thomas Müller, Cambridge (GB); Tuomas Pertti Jonathan Knowles, Cambridge (GB); Colin George Kemp, Cambridge (GB); Daniel Peterson Godfrey, Cambridge (GB)

(73) Assignee: Fluidic Analytics Limited, Cambridge (GB)

( * ) Notice: Subject to any disclaimer, the term of this patent is extended or adjusted under 35 U.S.C. 154(b) by 0 days.

(21) Appl. No.: 16/091,277

(22) PCT Filed: Apr. 4, 2017

(86) PCT No.: PCT/GB2017/050941
§ 371 (c)(1),
(2) Date: Oct. 4, 2018

(87) PCT Pub. No.: WO2017/174975
PCT Pub. Date: Oct. 12, 2017

(65) Prior Publication Data

US 2020/0254448 A1 Aug. 13, 2020

(30) Foreign Application Priority Data

Apr. 6, 2016 (GB) ..... 1605845

(51) Int. Cl.
*B01L 3/00* (2006.01)

(52) U.S. Cl.
CPC ..... *B01L 3/502715* (2013.01); *B01L 3/50273* (2013.01); *B01L 3/502746* (2013.01);
(Continued)

(58) Field of Classification Search
CPC ..... B01L 3/502715; B01L 3/50273; B01L 3/502746; B01L 2200/027; B01L 2200/10;
(Continued)

(56) References Cited

U.S. PATENT DOCUMENTS 7,122,156 B2 * 10/2006 Bergh ..... B01J 4/00 422/606
9,952,222 B2 4/2018 Yates et al.
(Continued)

FOREIGN PATENT DOCUMENTS

EP 1 898 210 A2 3/2008
WO WO 01/66245 A2 9/2001
(Continued)

OTHER PUBLICATIONS

International Search Report and Written Opinion for PCT/GB2017/050941 dated Jul. 12, 2017. 10 pages.
(Continued)

*Primary Examiner* — Jennifer Wecker
*Assistant Examiner* — Jonathan Bortoli
(74) *Attorney, Agent, or Firm* — Wolf, Greenfield & Sacks, P.C.

(57) ABSTRACT

A device for controlling a fluid flow in an array of fluid pathways on a microfluidic chip is provided. The device comprising: two or more resistors provided upstream of the chip wherein each upstream resistor is configured to provide a resistance at an upstream end of a fluid pathway; two or more resistors provided downstream of the chip wherein each downstream resistor is configured to provide a resistance at a downstream end of a fluid pathway, wherein the values of the resistances are selected in order to control a proportion of fluid that flows through each fluid pathway.

9 Claims, 1 Drawing Sheet

(52) U.S. Cl.
CPC ..... *B01L 2200/027* (2013.01); *B01L 2200/10* (2013.01); *B01L 2300/0867* (2013.01); *B01L 2400/0487* (2013.01)

(58) Field of Classification Search
CPC ..... B01L 2300/0867; B01L 2400/0487; B01L 2400/086; B60L 3/00
USPC ..... 422/502
See application file for complete search history.

(56) References Cited

U.S. PATENT DOCUMENTS

| | | | |
|---|---|---|---|
| 9,958,369 | B2 | 5/2018 | Cohen et al. |
| 10,295,545 | B2 | 5/2019 | Yates et al. |
| 10,386,332 | B2 | 8/2019 | Herling et al. |
| 10,620,102 | B2 | 4/2020 | Mueller et al. |
| 10,670,504 | B2 | 6/2020 | Cohen et al. |
| 2002/0153046 | A1 | 10/2002 | Dantsker et al. |
| 2004/0238052 | A1 | 12/2004 | Karp et al. |
| 2019/0201903 | A1 | 7/2019 | Douglas et al. |
| 2019/0234530 | A1 | 8/2019 | Douglas et al. |
| 2019/0247853 | A1 | 8/2019 | Douglas et al. |
| 2019/0247855 | A1 | 8/2019 | Douglas et al. |
| 2019/0331692 | A1 | 10/2019 | Yates et al. |
| 2019/0344267 | A1 | 11/2019 | Knowles et al. |

FOREIGN PATENT DOCUMENTS

| | | | |
|---|---|---|---|
| WO | WO 2005/058477 | A1 | 6/2005 |
| WO | WO 2010/114858 | A1 | 10/2010 |
| WO | WO 2016/010861 | A1 | 1/2016 |
| WO | WO 2017/141048 | A1 | 8/2017 |
| WO | WO 2017/174975 | A1 | 10/2017 |
| WO | WO 2018/046952 | A1 | 3/2018 |

OTHER PUBLICATIONS

Search Report for App. No. GB1605845.5 dated Oct. 4, 2016. 3 pages.

* cited by examiner

FLOW BALANCING

This Application is a national stage filing under 35 U.S.C. § 371 of International Patent Application Serial No. PCT/GB2017/050941, filed Apr. 4, 2017, which claims priority to United Kingdom Application No. 1605845.5, filed Apr. 6, 2016, which are incorporated herein by reference in their entireties.

This invention relates to improvements in or relating to flow balancing in multiple pathways and, in particular, to flow balancing in microfluidic devices. Microfluidic devices have become a useful tool for handling minute volumes of biological and chemical samples, such as proteins or DNA solutions.

A large number of complicated biochemical reactions and/or processes may be carried out in microfluidic devices. In some instances, it may be useful to have more than one fluid flow in a microfluidic device in order to manipulate biological reactions and/or processes at different stages. Therefore, it is often highly desirable to split a fluid flow from a single microfluidic pathway into multiple pathways on a microfluidic chip. In addition, it is also equally desirable to combine different fluid flows from two or more microfluidic pathways into one pathway. However, splitting or combining fluid flows from a single or multiple pathways into other pathways is difficult to control in microfluidic devices.

Controlling and balancing flow rates in microfluidic devices are usually achieved using a network of internal microfluidic resistors. These internal resistors provide a degree of control for splitting a fluid flow from one microfluidic pathway into multiple pathways. However, microfluidic chips comprising such internal resistors are often difficult and expensive to fabricate, due to the fact that the internal microfluidic resistors must be fabricated or calibrated to a high degree of accuracy and chip-to-chip and batch-to-batch variations need to be minimised. Slight variations between internal microfluidic resistors may have an impact on the proportion of fluid flowing from a common microfluidic pathway into the respective pathways or from several pathways into one common pathway.

Although pressure controlled flow is commonly used in microfluidic devices especially when high flow stability is required, the flow rates remains unknown. Therefore, in order to control and balance the flow rates inside a microfluidic device, the flow rates must be accurately determined.

It is against this background that the present invention has arisen.

According to the present invention there is provided a device for controlling a fluid flow in an array of fluid pathways on a microfluidic chip, the device comprising: two or more resistors provided upstream of the chip, wherein each upstream resistor is configured to provide a resistance at an upstream end of a fluid pathway; two or more resistors provided downstream of the chip, wherein each downstream resistor is configured to provide a resistance at a downstream end of a fluid pathway, wherein the values of the resistances are selected in order to control a proportion of fluid that flows through each fluid pathway.

Providing two or more upstream and downstream resistors is particularly useful for applying a local resistance at the upstream and downstream ends of a fluid pathway thereby altering the pressure differential across the fluid pathway resulting in a modification of the flow rate of fluid through said pathway. Furthermore, as the resistors are provided on the device, rather than on the chip, the same set of resistors can be used with many chips when the chips are placed, sequentially, into the device.

The provision of the resistors within the device, but not integrated within the chip, provides considerable advantages over chip-based configurations. The provision of "off-chip" resistors allows chips with lower manufacturing tolerances to be deployed within the device. Chip variability is therefore less likely to affect the overall functioning of the device as the device may be provided, over a lifetime, with a plurality of different chips each having slightly different configuration. However, the off-chip resistors will remain constant and therefore the calibration of the device as a whole will be affected less by the change of the chip. Furthermore, the off-chip resistors can have much higher values than can easily be achieved on the chip. As a result, the effect of any on-chip resistance will be negligible in comparison with the external or off-chip resistors provided.

The device of the present invention is optimised for use with complex networks of fluid pathways that include two or more inlets and two or more outlets. The fluid pathways within the network are combined and split as required. Whilst the present invention can control and balance the flows in any configuration of fluid pathways, it is at its most effective where there is at least one point in the network which has fewer fluid pathways than inlets or outlets.

In some embodiments, the device further comprises a connector block (manifold) to position the chip and to interface it with the resistors.

The values of resistance provided by the upstream and downstream resistors may be large in comparison to the internal resistance of the fluid pathways. This has the effect that the value of resistance of the pathway itself becomes irrelevant to the flow along that pathway. This results in a relaxation in the manufacturing tolerances required on the fluid pathways. In this context, large means at least several times bigger or ten times the internal resistance. For example, the external resistors may be 3, 10, 20, 30, 50, 100 or even 1000 times the internal resistance of the fluid pathway.

In some embodiments, the number of upstream resistors exceeds the number of downstream resistors. Alternatively, the number of downstream resistors exceeds the number of upstream resistors. In a further embodiment, the number of upstream resistors may equal the number of downstream resistors.

The number of upstream and downstream resistors within the fluid pathways may provide precise and predictable fluid flows. The precise and predictable fluid flows within the fluid pathways can be particularly valuable for performing and controlling reactions such as chemical or biological synthesis, for example. Furthermore, a combination of upstream and downstream resistors may provide a means for controlling one or more flow rates within the fluid pathways.

In some embodiments, variation in flow rates can be provided in the range of 0.1-10000 μl/hr with optimum operating flow rates being in the region of 100 μl/hr. These flow rates may be achieved through the application of a positive pressure at a set of inlets, a negative pressure at a set of outlets or a combination of positive and negative pressures. The applied pressure differences can be between 0 to 2000 kPa, or it may exceed 50, 100, 200, 1000 kPa. The applied pressure differences may be less than 2000 kPa, 500 kPa, 200 kPa or 100 kPa.

The invention will now be further and more particularly described, by way of example only, and with reference to the accompanying drawings, in which.

The present invention relates to a network of upstream and downstream resistors to control and balance one or more flow rates inside a microfluidic device.

Figure 1:
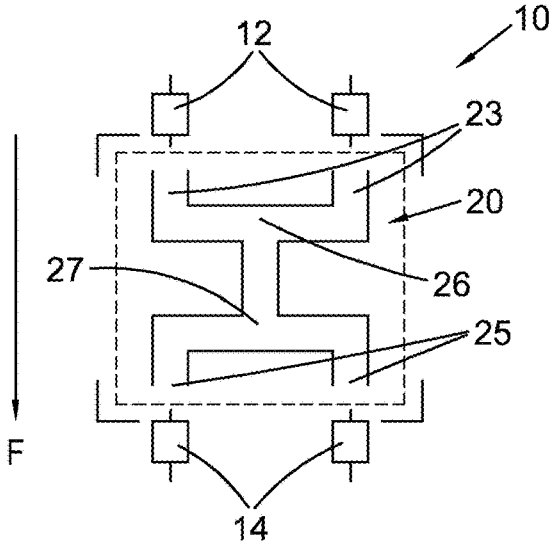
FIG. 1 shows a device according to the present invention applied to a chip with two inputs and two outputs.

Referring to FIG. 1, there is provided a device 10 for controlling a fluid flow in an array of fluid pathways 23, 25 provided on a chip 20. The fluid flows through the device 10 in the direction marked by arrow F. In the example of the device illustrated in FIG. 1, there are two upstream resistors 12. Each upstream resistor 12 is configured to provide a resistance at an upstream end of a corresponding fluid pathway 23. This example of the device 10 also includes two downstream resistors 14, which are configured to provide a resistance at a downstream end of a corresponding fluid pathway 25. The values of the resistances are selected in order to control a proportion of fluid that flows through each fluid pathway.

The chip 20 illustrated in FIG. 1 is configured to combine the two upstream fluid pathways 23 at a combination point 26. The combination point 26 enables the mixing of the fluids from the two upstream fluid pathways 23. The fluid is then divided at a splitting point 27 to provide fluid into two downstream fluid pathways 25.

The values of resistance provided by the upstream and downstream external resistors 12, 14 are large in comparison to the internal resistances of the fluid pathways 23, 25 so that the effects of the internal resistances to the fluid flow along the fluid pathways are drastically reduced/suppressed. As a result, the "off-chip" upstream and downstream resistors disclosed in this invention may be used on microfluidic chips with poor tolerances.

As used herein, and unless otherwise specified, the term "tolerance" refers to an error in the resistance of a part, for example a fluid pathway. For example, the tolerance in the resistance may be 1, 5, 10, 20, 40 or 50%. An example of a poor tolerance in the resistance of a chip may be equal to or more than 5%. In contrast, an example of a good tolerance in the chip's resistance may be equal to or less than 5%.

The values of the resistances or resistors may have a range of 0.001 kPa/(μl/hr) to 100 kPa/(μl/hr).

The device 10 further comprises a connector block 16, which is configured to position the chip 20 for effective connection to the upstream 12 and downstream 14 resistors. The connector block 16 comprises an indentation in a surface provided in the device 10 which is shaped to receive the chip 20.

Resistors may have a circular cross-section, which may have a diameter of between 10 and 1000 μm, or it may exceed 10, 100, 250, 500 or 750 μm. The diameter of the resistor may be less than 1000, 750, 500 or 250, 100 or 50 μm. An example of a resistor may be a capillary resistor. Alternatively, resistors may have a rectangular cross-section as from milling or moulding from a milled tool.

In some embodiments, the resistors may have a length of between 1 to 1000 mm, or it may exceed 250, 500 or 750 mm. The resistor may be less than 1000, 750, 500, 250 or 100 mm in length.

A combination of upstream and downstream resistors is configured to control and balance a flow rate within the various fluid pathways within the chip 20. In some embodiments, a pressure difference between the inlets and the outlets of the device, typically between 0 kPa to 2000 kPa, may be applied along the fluid pathways to provide a fluid flow rate in the range of 0.1 to 10000 μl/hr, for example 100 μl/hr, along the fluid pathways. A combination of upstream resistors may be used to effectively control the relative flow rates at the upstream ends of the fluid pathways. As the fluid flows along the fluid pathways, a combination of downstream resistors is then used to balance the flow rates at the downstream ends of the fluid pathways. The combination of upstream and downstream resistances is used to set the overall flow rates. The precise and predictable fluid flows within a microfluidic chip can be particularly valuable for performing and controlling reactions such as chemical or biological synthesis, or for separating and analysing components in a fluid, for example.

There can be provided an array of upstream 23 and downstream 25 fluid pathways in the present invention. The splitting of fluid pathways in the microfluidic chips may be provided to allow a separation or analysis of biological components, such as proteins or nucleic acids, in the fluid flows. Conversely, two or more fluid pathways may be combined together in order to mix biological or chemical components, or to provide an auxiliary fluid for subsequent separation and analysis of fluid flows.

The two upstream resistors 12 may provide a controlled flow rate along the fluid pathway. The fluid flow is then combined temporarily and then separated into two different downstream fluid pathways. The relative values of the downstream resistors 14 dictate the proportion of the fluid that flows in each of the downstream fluid pathways 25. This may provide reproducibility and stability to the flow rates within a microfluidic chip, which can be an important requisite for the analysis of a component within the fluid flow.

Figure 2:
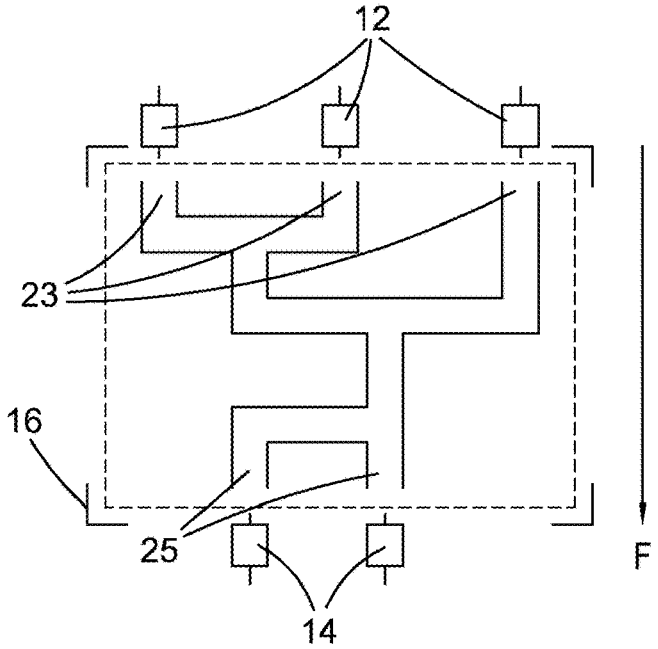
FIG. 2 shows a device according to the present invention applied to a chip with three inputs and two outputs.

In FIG. 2, there is shown another example of how the device 10 can be configured to control how upstream 23 and downstream 25 fluid pathways are combined on a microfluidic chip 20 as fluid flows through the device 10 in the direction indicated by arrow F. In FIG. 2, the chip 20 is provided with three upstream fluid pathways 23 which combined together via two combination points 26 to provide a single fluid pathway which is then divided at a splitting point 27 to provide two downstream fluid pathways 25. This configuration of fluid pathways could be used to combine two reagents and then to provide a labelling flow from the third inlet. The combined flow can then be split to provide two separate output streams. The split is effectively controlled by the values of the downstream resistors 14.

Figure 3:
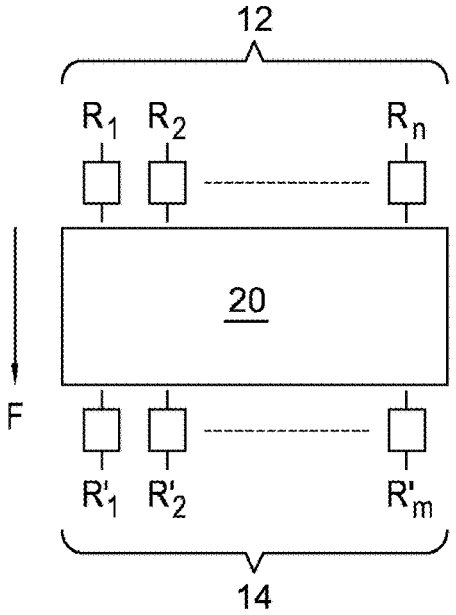
FIG. 3 shows a generalised example of a device according to the present invention applied to a generic chip.

FIG. 3 provides a generalisation of the device 10 configured to act on a generic chip 20. An array of upstream resistors marked individually as $R_1$, $R_2$, . . . $R_n$ and referred to collectively as upstream resistors 12 is provided and an array of downstream resistors marked individually as $R_1^I$, $R_2^I$ . . . $R_m^I$ and referred to collectively as downstream resistors 14 is also provided. In use the fluid flows through the device in the direction indicated by the arrow F. The number of resistors 12, 14 in use in any given situation will be dictated by the number of fluid pathways provided on the chip 20. The device 10 will be provided with the maximum number of resistors that are likely to be useful within the applications envisaged for the device 10. For example, the upstream and downstream arrays may include 2, 3, 5, 10, 20 or even 100 resistors.

In some embodiments, not illustrated in the accompanying drawings, the device 10 may comprise a set of connections (manifold) linking the resistances and the channel network.

In principle, it will be appreciated that the number of upstream and downstream fluid pathways within a microfluidic chip may vary substantially with the caveat of no closed loops. The fluid pathways are particularly useful for fluid handling for example, combining, mixing and separating fluid flows. The network of up- and downstream resistors allows for accurate and controlled flow rates in microfluidic chips with poor resistor tolerances.

It will further be appreciated by those skilled in the art that although the invention has been described by way of example with reference to several embodiments it is not limited to the disclosed embodiments and that alternative embodiments could be constructed without departing from the scope of the invention as defined in the appended claims.

The invention claimed is:

1. A device for controlling a fluid flow in an array of fluid pathways on a microfluidic chip, the device comprising:

the array of fluid pathways having two or more inlets and two or more outlets, wherein two or more fluid pathways are combined together on the chip and at least one fluid pathway of the array of fluid pathways is split into multiple fluid pathways on the chip;

two or more resistors provided upstream of the split of the array of fluid pathways of the chip wherein each upstream resistor is configured to provide a resistance at an upstream end of a fluid pathway;

two or more resistors provided downstream of the split of the array of fluid pathways, on the opposite side of the chip wherein each downstream resistor is configured to provide a resistance at a downstream end of a fluid pathway, wherein the values of the resistances are selected in order to control a proportion of fluid that flows through each fluid pathway.

2. The device according to claim 1, wherein the device further comprises a connector that interfaces the chip with the resistors.

3. The device according to claim 1, wherein the values of resistance are 0.001 kPa/(μl/hr) to 100 kPa/(μl/hr).

4. The device according to claim 1, wherein the number of upstream resistors exceeds the number of downstream resistors.

5. The device according to claim 1, wherein the number of downstream resistors exceeds the number of upstream resistors.

6. The device according to claim 1, wherein the number of upstream resistors equals the number of downstream resistors.

7. The device according to claim 1, wherein the two or more upstream resistors are provided with positive pressures to control fluid flow through each fluid pathway.

8. The device according to claim 1, wherein the two or more downstream resistors are provided with pressures below ambient pressure to control fluid flow through each pathway.

9. The device according to claim 1, wherein the values of the resistances are selected in order to achieve fluid flow rates in the region of 0.1-10000 μl/hr, in use.

* * * * *